US006202421B1

(12) United States Patent
Maguire et al.

(10) Patent No.: US 6,202,421 B1
(45) Date of Patent: Mar. 20, 2001

(54) DETACHABLE CRYOGENIC REFRIGERATOR EXPANDER

(75) Inventors: James F. Maguire, Andover; Peter M. Winn; Ahmed Sidi-Yekhelf, both of Framingham; Dariusz Antoni Bushko, Hopkinton, all of MA (US)

(73) Assignee: American Superconductor Corporation, Westborough, MA (US)

( * ) Notice: Subject to any disclaimer, the term of this patent is extended or adjusted under 35 U.S.C. 154(b) by 0 days.

(21) Appl. No.: 09/168,201

(22) Filed: Oct. 6, 1998

(51) Int. Cl.[7] ..... F17C 13/00; F25D 9/00
(52) U.S. Cl. ..... 62/50.7; 62/55.5; 62/402
(58) Field of Search ..... 62/402, 45.1, 48.1, 62/50.7, 55.5

(56) References Cited

U.S. PATENT DOCUMENTS 3,699,696 * 10/1972 Rhoton ..... 62/45.1
4,277,950 * 7/1981 Eigenbrod et al. ..... 62/55.5
5,429,155 * 7/1995 Brzyski et al. ..... 137/614.04
5,687,574 * 11/1997 Longsworth et al. ..... 62/55.5
5,910,104 * 6/1999 Dobak et al. ..... 600/121

* cited by examiner

*Primary Examiner*—William Doerrler
(74) *Attorney, Agent, or Firm*—Fish & Richardson P.C.

(57) ABSTRACT

A detachable work extraction system includes an expansion engine including a self-sealing coupling adapted to detachably connect the expansion engine to a cold box, and a hydraulic work extractor operatively connected to the expansion engine. A gas can travel from the cold box to the expansion engine through the self-sealing coupling. The gas is cooled by expansion of the gas in the expansion engine and work produced by the expansion of the gas is dissipated by the hydraulic work extractor. The expansion engine includes a cylinder housing a piston. The cylinder has a first self-sealing coupling defining an inlet and a second self-sealing coupling defining an outlet. The first and second self-sealing couplings each have a spring loaded seal. In the absence of an external force applied to the seal, the seal prevents flow of gas through the couplings.

25 Claims, 6 Drawing Sheets

DETACHABLE CRYOGENIC REFRIGERATOR EXPANDER

BACKGROUND OF THE INVENTION

The invention relates to a detachable cryogenic refrigerator expander.

Systems operating at cryogenic temperatures generally have a cryogenic refrigeration unit attached to the system to minimize or eliminate boil-off of the cryogenic coolant. A cryogenic refrigeration unit including an expansion device, compressor, and heat exchanger is known. High pressure fluid from the compressor is passed through the heat exchanger and introduced into the expansion device. Expansion of the fluid in the expansion device reduces the temperature and pressure of the fluid. Heat energy is transferred from the expanding fluid by the performance of mechanical work.

When the expansion device must be removed, either for maintenance or replacement, the cryogenic system is typically exposed to warmer temperatures and potential contaminates. Maintenance of the unit generally requires that the cryogenic system be shut down for at least a day.

SUMMARY OF THE INVENTION

A light weight, easily maintained work extraction system for cooling a gas provides reliable, low cost refrigeration in about the 4 K to 40 K temperature range. The system includes an expansion engine assembly and a hydraulic work extractor assembly. When an inlet valve of the expansion engine assembly is opened, gas enters the cold end and expands, raising an expansion piston and raising a hydraulic piston coupled to the expansion piston. This forces hydraulic fluid through a needle valve creating a head due to flow friction. The inlet valve is closed when the piston is partially up the stroke to allow the gas to expand to a lower pressure. When the full stroke is reached the exhaust valve is opened and pneumatic spring pistons push the expansion piston back down, exhausting the gas in the cylinder for the next cycle.

According to the invention, a detachable work extraction system includes an expansion engine including a self-sealing coupling adapted to detachably connect the expansion engine to a cold box, and a hydraulic work extractor operatively connected to the expansion engine. A gas can travel from the cold box to the expansion engine through the self-sealing coupling. The gas is cooled by expansion of the gas in the expansion engine and work produced by the expansion of the gas is dissipated by the hydraulic work extractor.

Embodiments of this aspect of the invention may include one or more of the following features.

The self-sealing coupling includes a spring loaded seal. The expansion engine includes a cylinder housing a piston. The cylinder has a first self-sealing coupling defining an inlet and a second self-sealing coupling defining an outlet. The first and second self-sealing couplings each have a spring loaded seal. In the absence of an external force applied to the seal, the seal prevents flow of gas through the couplings.

An inlet valve assembly, for example, an electric actuated spring biased valve, controls the flow of gas through the inlet. An outlet valve assembly, for example, a pneumatic actuated spring biased valve, controls the flow of gas through the outlet.

In the illustrated embodiment, a return assembly, for example, a pneumatically controlled return assembly, lowers the piston. The work extraction system includes a displacement transducer for monitoring the position of the piston.

The hydraulic work extractor includes a cylinder, piston, and oil loop. A control valve of the hydraulic work extractor dissipates the work produced by the expansion of the gas. The control valve includes a throttle valve and a check valve.

According to another aspect of the invention, a refrigeration system includes a cold box and a detachable work extraction system. The cold box has a first self-sealing coupling, and an expansion engine of the work extraction system has a second self-sealing coupling for detachably connecting the expansion engine to the cold box self-sealing coupling.

Embodiments of this aspect of the invention may include a hydraulic work extractor operatively connected to the expansion engine.

According to another aspect of the invention, a method for connecting a cold box and a work extraction engine includes detachable connecting the work extraction engine to the cold box, and removably disconnecting the work extraction engine from the cold box without substantial loss of gas from the cold box.

An advantage of this system is its ease of maintenance. Self sealing couplings allow the expander module to be removed and replaced without warming the system or contaminating the inner components. With a dual expander arrangement, the system may not even be required to be shut down. The hydraulic work extraction device allows the expander module to be light enough to be removed by one person and reattached relatively easily.

BRIEF DESCRIPTION OF THE DRAWINGS

Other objects, features and advantages of the invention will be apparent from the following description taken together with the drawings in which.

DESCRIPTION OF THE PREFERRED EMBODIMENT

Figure 1:
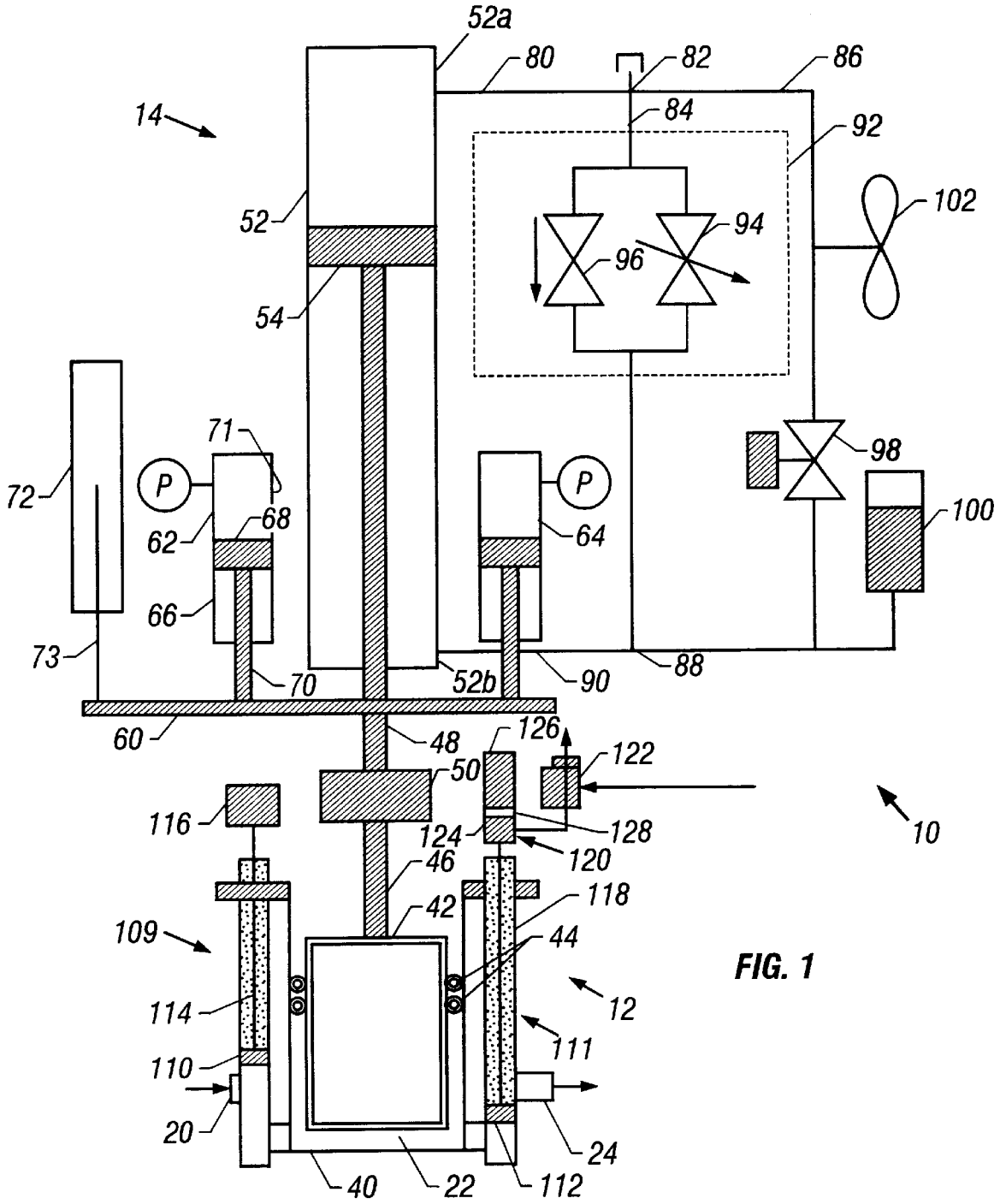
FIG. 1 is a schematic of a work extraction system according to the invention, shown during a gas intake portion of its cycle.

Referring to FIG. 1, an illustrative schematic diagram, a work extraction system 10 for cooling a gas includes an expansion engine assembly 12 and a hydraulic work extractor assembly 14. When the cooled gas is to be used, for example, as a refrigerant for a superconducting magnet, pre-cooled, high pressure gas, for example, helium gas at a temperature of 80 K, and a pressure of 250 psi, enters expansion engine assembly 12 at an inlet 20 and expands within a piston chamber 22. Due to the expansion of the gas, the helium gas exiting expansion engine assembly 12 at an outlet 24 is at a lower pressure, for example, 30 psi, and lower temperature, for example, 40 K, than the inlet gas. The work produced by expansion of the gas is dissipated by hydraulic work extractor assembly 14.

Figure 3A:
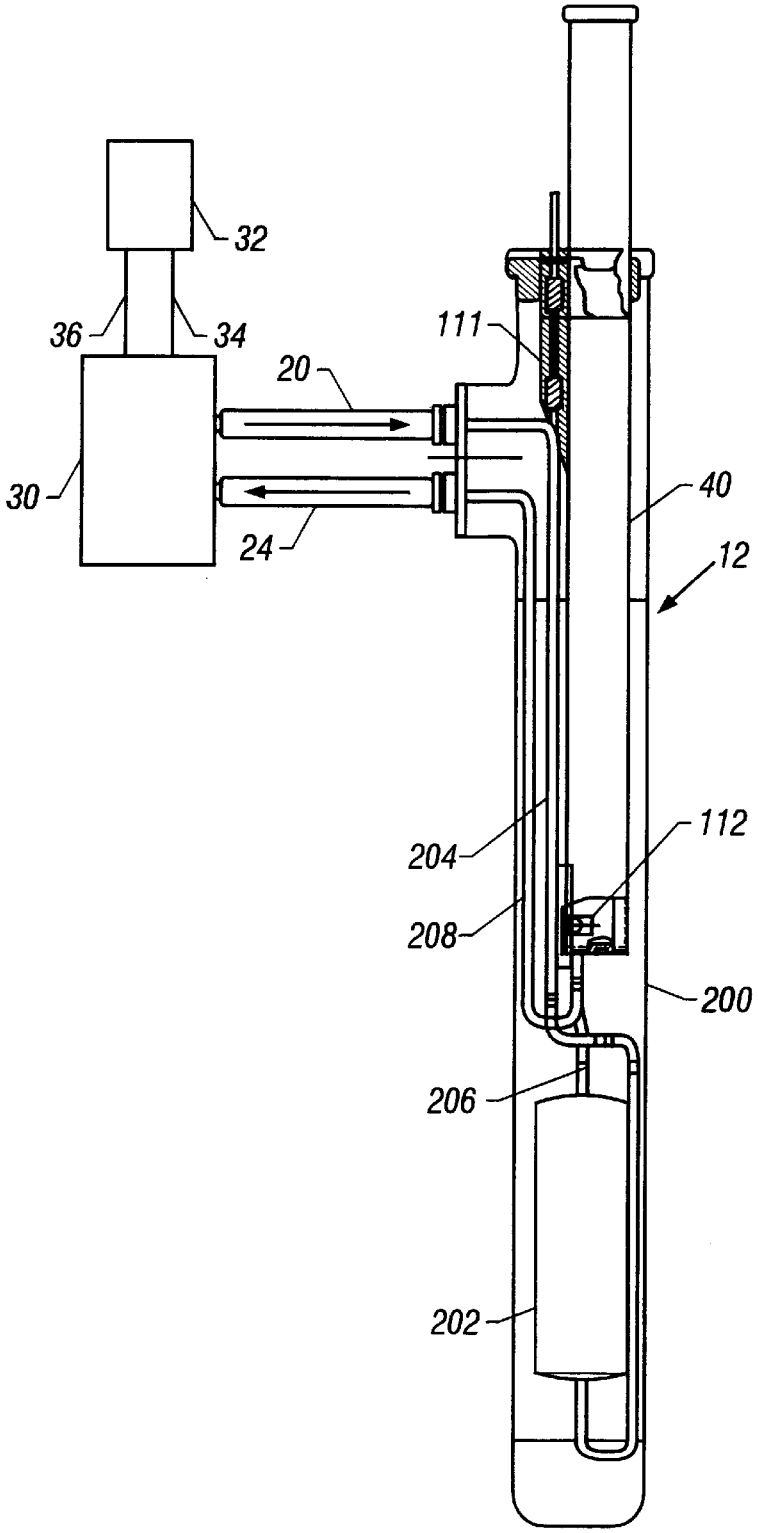
FIGS. 3A and 3B are side and front views, respectively, of an expansion engine assembly of the work extraction system of FIG. 1.

Referring to FIG. 3A, which illustrates assembly 12 in more detail, inlet 20 and outlet 24 of expansion engine assembly 12 are connected to a cold box 30. Except for couplings for connecting the inlet and outlet to the cold box, described below, cold box 30 is a conventional pre-cooling unit housing the heat exchanger and valves of the refrigeration system. Cold box 30 is connected to a compressor 32 by high and low pressures lines 34, 36, respectively. The cooled gas entering cold box 30 from outlet 24 is fed to the superconducting magnet.

Referring again to FIG. 1, expansion engine assembly 12 includes a piston cylinder 40 housing a piston 42. Piston chamber 22 defined between cylinder 40 and piston 42 is sealed, for example, by o-rings 44. A connecting rod 46 is attached to piston 42 for movement with piston 42. Connecting rod 46 is attached to a hydraulic piston rod 48 of hydraulic work extractor assembly 14 by a coupler 50, for example, a U-joint. The use of a U-joint for coupler 50 accounts for any misalignment between connecting rod 46 and hydraulic piston rod 48. Hydraulic piston rod 48 extends into a hydraulic cylinder 52 and terminates in a hydraulic piston head 54.

A control bar 60 is attached to hydraulic piston rod 48 for movement with piston rod 48. Two pneumatic springs 62, 64 are attached to control bar 60. Each pneumatic spring 62, 64 includes a pneumatic cylinder 66, a piston 68, and a piston rod 70 attached to control bar 60 for movement with control bar 60. Air can be introduced and bled from a top portion 71 of cylinder 66 to push piston 68 downward and allow piston 68 to move upward. A linear variable differential transducer (LVDT) 72 is attached to control bar 60 by an arm 73 to monitor the position of hydraulic piston head 54.

Oil is contained within hydraulic cylinder 52. An oil line 80 is connected to hydraulic cylinder 52 at an upper section 52*a* of cylinder 52. Oil line 80 splits at 82 into a main flow path 84 and a secondary flow path 86. The two flow paths 84, 86 join at 88 to form an oil line 90 which is connected to hydraulic cylinder 52 at a lower section 52*b* of cylinder 52. A valve 92 is located in main flow path 84. Valve 92, for example, a Model Number PF600 BV40 Flow Control Valve from Parker Motion & Control, Elyria, Ohio, includes a throttle control valve 94 for metering flow through valve 92 and a check valve 96. A fan 102 is used to cool the hydraulic fluid as it flows through control valve 94. Located in secondary flow path 86 is a solenoid valve 98, and connected to oil line 90 is an oil buffer 100, for purposes described below.

Entry and exhaust of gas from expansion engine assembly 12 through inlet 20 and outlet 24 are controlled by an inlet valve assembly 109 and an outlet valve assembly 111, respectively. An inlet valve 110 of assembly 109, for example, an electrically actuated control valve, has a first, closed position in which gas is prevented from flowing through inlet 20 into chamber 22, and a second, open position permitting the flow of gas into chamber 22. Inlet valve 110 is biased closed by a spring 114, and is opened against the force of spring 114 by a solenoid 116. Inlet valve assembly 109 is rated, for example, at a 20% duty cycle and can lift a fifty pound load.

An outlet valve 112 of outlet valve assembly 111, for example, a pneumatically actuated control valve, has a first, closed position in which gas is prevented from flowing through outlet 24, and a second, open position permitting the flow of gas through outlet 24. Outlet valve 112 is biased closed by a spring 118, and is opened against the force of spring 118 by a pneumatic piston 120. Pneumatic piston 120 includes a piston cylinder 126 housing a piston head 128. A three-way valve 122 controls the flow of air to and from a lower chamber 124 of piston cylinder 126 to raise and lower outlet valve 112 between its opened and closed positions. Outlet valve assembly 111 is rated, for example, at a 50% duty cycle and can lift an eighty pound load.

In operation, with outlet valve 112 in its closed position, inlet valve 110 is opened to permit the high pressure gas to enter chamber 22. The gas pushes against piston 42 lifting piston 42. The motion of piston 42 causes hydraulic piston rod 48, control bar 60, piston rods 70, and arm 73 of LVDT 72 to rise. As the hydraulic piston head 54 rises, oil is forced into oil line 80, through control valve 94, and through oil line 90 to the lower end 52*b* of hydraulic cylinder 52 (check valve 96 and solenoid 98 are closed at this point in the operation).

When control bar 60 has risen, for example, about one inch, as measured by LVDT 72, a control signal is sent to solenoid 116 by a controller (not shown). Solenoid 116 is actuated to close inlet valve 110. With inlet valve 110 and outlet valve 112 both closed, the gas trapped within chamber 22 expands isentropically lowering the pressure and temperature of the gas within chamber 22. The work produced by the expansion of the gas within chamber 22 is dissipated in the form of heat by the resulting flow of oil through throttle valve 94.

As piston head 54 reaches the top of its stroke, solenoid valve 98 is opened. This allows the oil to bypass throttle valve 94 and flow through secondary flow path 86, thus reducing the friction against which the oil flows. This permits the stroke of piston head 54 to be maximized, allowing the pressure of the gas in chamber 22 to drop lower, thus increasing the efficiency of the system.

Figure 2:
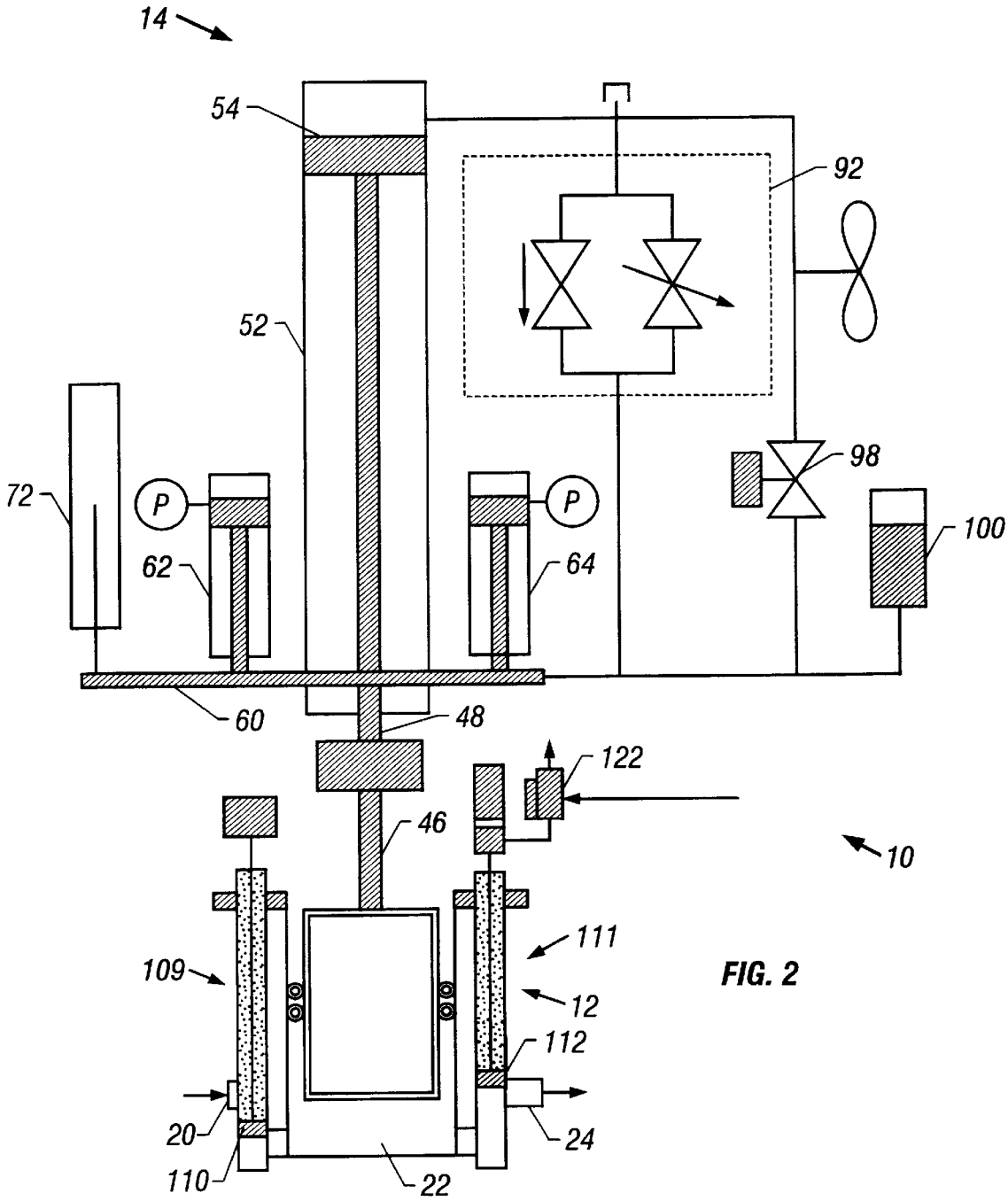
FIG. 2 is a schematic of the work extraction system of FIG. 1, shown during a gas exhaust portion of its cycle.

At the end of the intake stroke (see FIG. 2), as measured by LVDT 72, three way valve 122 is positioned to allow air to flow into lower chamber 124 of piston cylinder 126 raising piston head 128. This opens valve 112 permitting the low temperature, low pressure gas to exit chamber 22. Concurrently with the opening of valve 112, check valve 96 is opened, solenoid 98 is closed, and pressurized air is delivered to top portion 71 of pneumatic springs 62, 64. Pneumatic springs 62, 64 act to lower control bar 60 and thus lower piston head 54, piston rod 48, connecting rod 46, and piston 42. The lowering of piston 42 forces the low temperature, low pressure gas to exit chamber 22 through outlet 24.

As piston head 54 lowers, oil is forced from the lower section 52*b* of cylinder 52 through flow line 90, up flow path 84 through check valve 96 and up flow path 86, and out oil line 80 into the upper section 52*a* of cylinder 52. As piston head 54 reaches the bottom of the stroke, the intake and exhaust cycle in repeated.

Oil buffer 100 provides space for accommodating the change in oil volume in cylinder 52 which results from the movement of piston rod 48 into and out of cylinder 52. Oil buffer 100 also acts as an oil reservoir in case of oil leakage from hydraulic work extractor assembly 14.

Figure 3B:
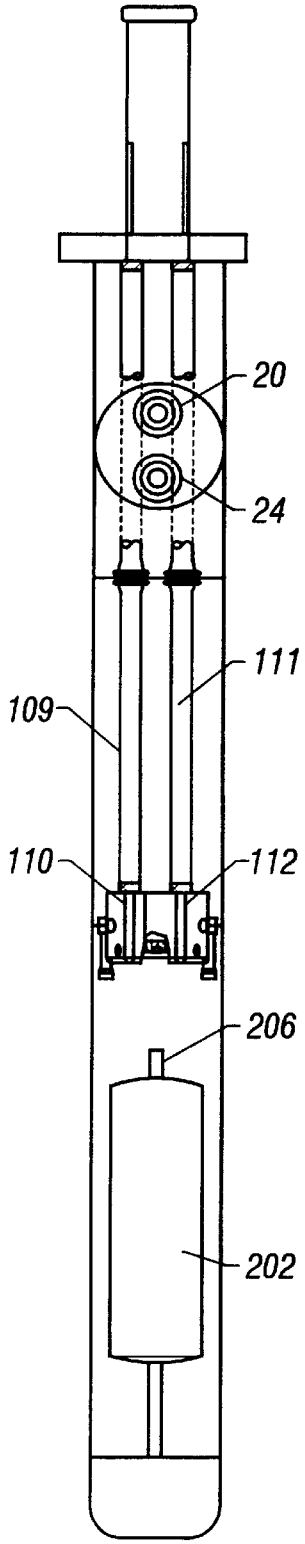

Referring to FIGS. 3A and 3B, expansion engine assembly 12 includes a vacuum insulated housing 200 enclosing piston cylinder 40 and a charcoal filter 202. High pressure gas entering through inlet 20 flows through an inlet gas line 204 to charcoal filter 202. The gas exits charcoal filter 202 through gas line 206 which is connected to inlet valve assembly 109. Gas exiting piston cylinder 40 travels through an outlet gas line 208 connected between outlet valve assembly 111 and outlet 24. Inlet gas line 204 and outlet gas line 208 each include relief valves, not shown, for relieving over pressure, for example, pressures over 300 pounds in inlet gas line 204 and pressures over 50 pounds in outlet gas line 208 where the high pressure gas entering through inlet 20 is at 250 psi.

Figure 4:
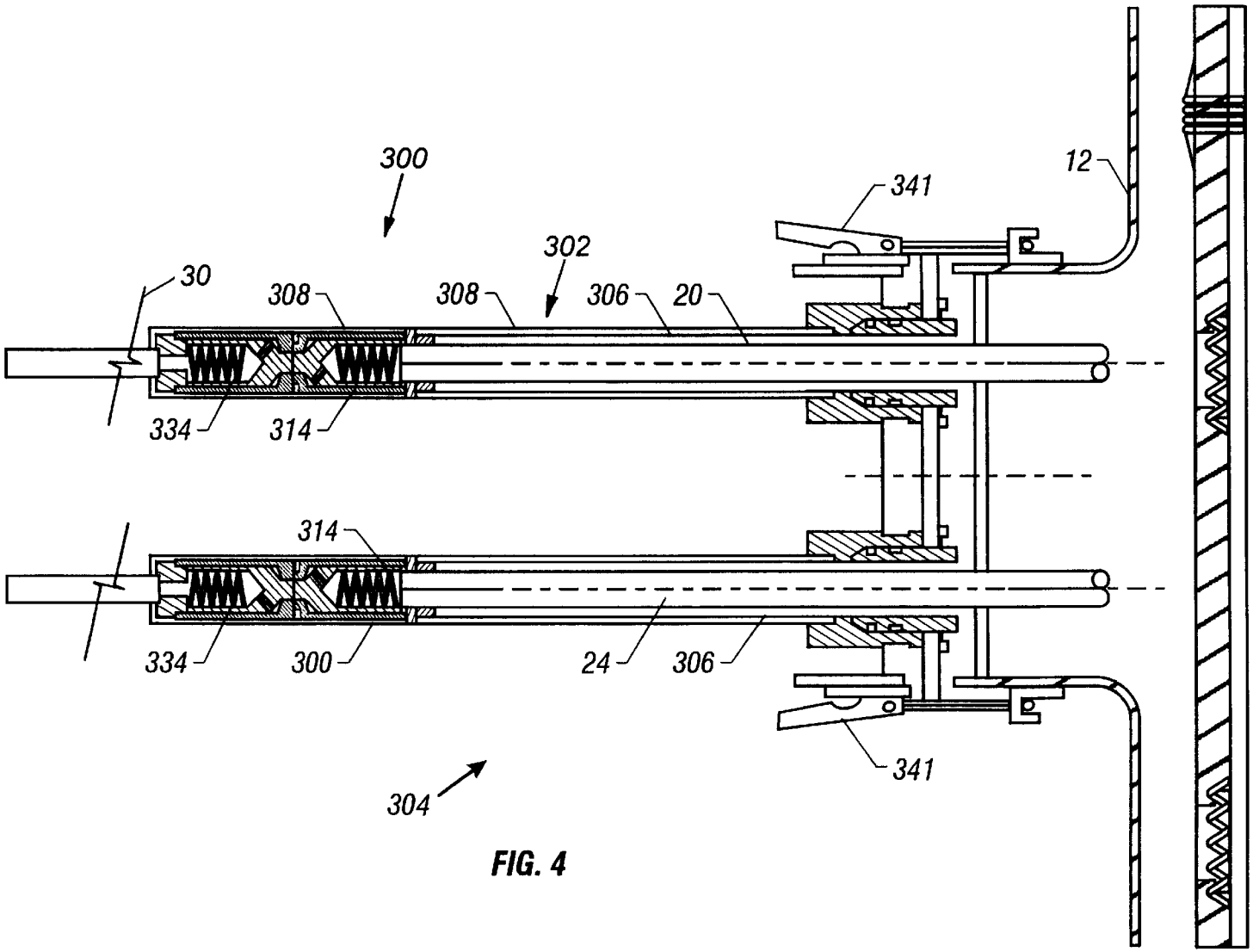
FIG. 4 shows inlet and outlet couplers connecting the expansion engine assembly to a cold box.

Referring to FIG. 4, a self-sealing bayonet coupling 300 allows the work extraction system 10 to be easily replaced at regular maintenance intervals without contaminating the refrigeration system (cold box 30 and compressor 32). Coupling 300 includes a high pressure inlet bayonet 302 defining inlet 20, and a low pressure exhaust bayonet 304 defining outlet 24. Each bayonet has a male coupler assembly 306 and a female coupler assembly 308. The inlet and outlet male couplers 306 are mounted to expansion engine assembly 12, and the inlet and outlet female couplers 308 are mounted to cold box 30.

Figure 5A:
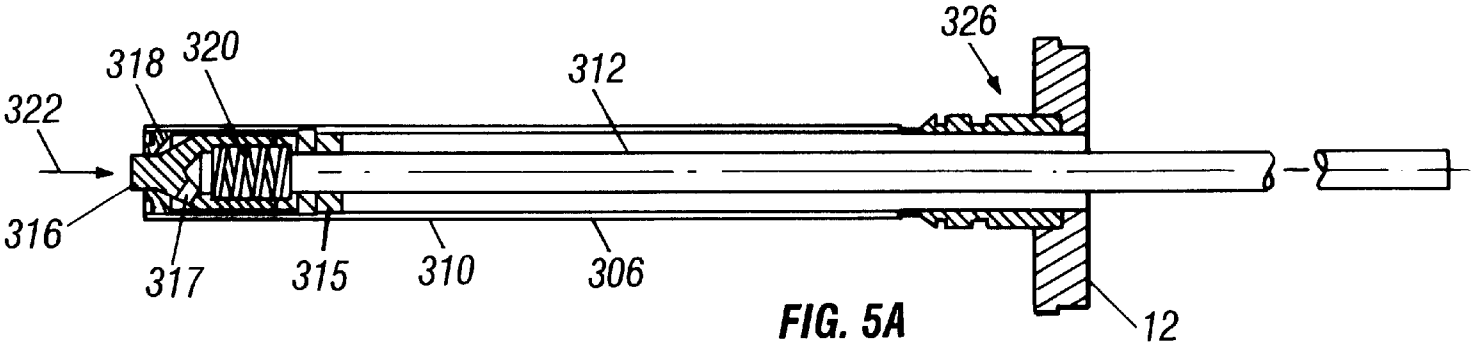
FIG. 5A is a cross-sectional side view showing a male coupler assembly attached to the expansion engine assembly.
Figure 5B:
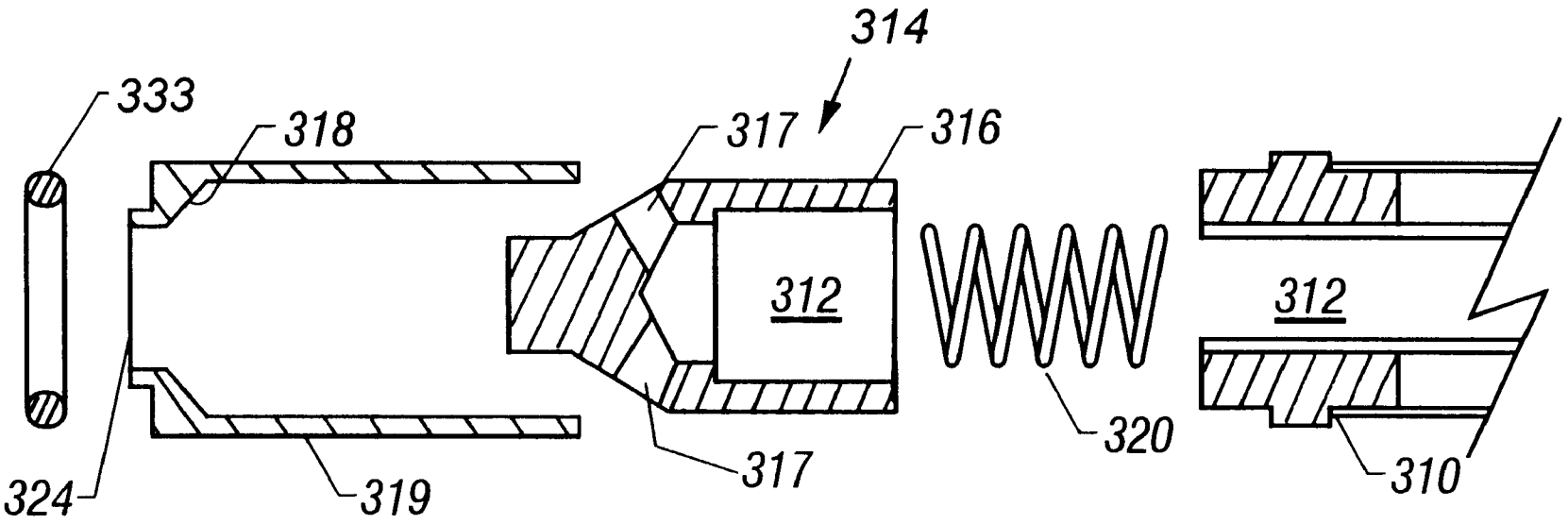
FIG. 5B is an exploded view of a poppet valve of the male coupler assembly of FIG. 5A.

Referring to FIG. 5A, each male coupler assembly 306 has a body 310 defining a flow passage 312. A poppet valve 314 is mounted to the end 315 of body 310. Referring also to FIG. 5B, poppet valve 314 includes a seal 316 defining a flow path 317 in fluid communication with flow passage 312. Seal 316 is biased to a closed position by a spring 320. In the closed position, seal 316 is held against a seat 318 defined by a cover 319 of poppet valve 314. When a force is applied to seal 316 (along the direction of arrow 322), seal 316 is moved away from seat 318 against the force of spring 320. The movement of seal 316 places flow path 317 in fluid communication with an aperture 324 defined by cover 319 permitting flow of gas through male coupler assemblies 306. Cover 319 is attached to body 310 by, for example, welding. Each male coupler assembly 306 includes a connector 326 for detachable coupling the male coupler assembly to a respective female coupler assembly 308.

Figure 6:
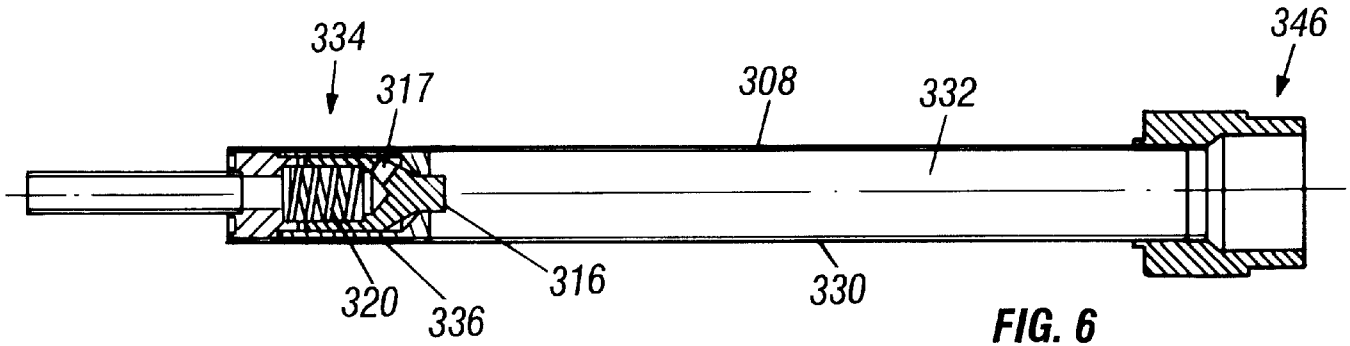
FIG. 6 is a cross-sectional side view showing a female coupler assembly attached to the cold box.

Referring to FIG. 6, each female coupler 308 has a body 330 defining a flow passage 332. A poppet valve 334 (identical to poppet valve 314) is mounted within an end 336 of body 330. Each female coupler assembly 308 includes a connector 346 for detachable coupling the female coupler assembly to a respective male coupler assembly 306.

Referring again to FIG. 4, when expansion engine assembly 12 is connected to cold box 30, male coupler assemblies 308 are slid into respective female coupler assemblies 306. This causes poppets 314, 334 to press against each other forcing both seals 316 against their springs, opening the gas passages between the cold box 30 and the expansion engine assembly 12 (as shown in FIG. 4). An o-ring 333 (see FIGS. 5A and 5B) provides a seal between the two poppets. When the bayonets are fully engaged, a set of external clamps 341 hold the female and male coupler assemblies together. When maintenance is required, work extraction system 10 can be easily removed by unclamping the assembly and pulling the male coupler assemblies 308 out of the female coupler assemblies 306. The poppets automatically seal to maintain the pressure of both sides of the system and prevent substantial loss of gas from the cold box.

Depending upon the application, gas entering work extraction system 10 is generally at a pressure of about 250 psi, and the pressure of the exhaust gas is in the range of about 0 to 50 psi. Work extraction system 10 produces a temperature drop to about half the intake gas temperature. Depending upon the application, the intake gas will generally be selected to be between about 8 K and room temperature.

Work extraction system 10 is a dry expander, that is, the system is designed for use where the intake and exhaust are a gas. Pistons 42 and 54 of work extraction system 10 can be run up to about seventy strokes/minute. The percentage of time in a single intake stroke that the inlet valve is open, that is, the cut-off time, is about 30%. The overall size of work extraction system 10 is, for example, about 4 feet long and 6 inches in diameter. System 10 weighs, for example, about 40 pounds.

Other embodiments are within the scope of the following claims. For example, a pneumatic rather than an electric actuator can be used to control input valve 110 if input valve 110 is being run at a duty cycle greater than about 30%. An electric actuator can control output valve 112 if the system is running at low pressure.

What is claimed is:

1. A detachable work extraction system, comprising:

an expansion engine including a self-sealing coupling adapted to detachably connect the expansion engine to a cold box, and a hydraulic work extractor operatively connected to the expansion engine, wherein a cryogenic gas can travel from the cold box to the expansion engine through the self-sealing coupling, the gas is cooled by expansion of the gas in the expansion engine and work produced by the expansion of the gas is dissipated by the hydraulic work extractor.

2. The detachable work extraction system of claim 1 wherein the self-sealing coupling comprises a spring loaded seal.

3. The detachable work extraction system of claim 1 wherein the expansion engine comprises a cylinder housing a piston, the cylinder including a first self-sealing coupling defining an inlet and a second self-sealing coupling defining an outlet.

4. The detachable work extraction system of claim 3 wherein the first and second self-sealing couplings each comprise a spring loaded seal, in the absence of an external force applied to the seal, the seal prevents flow of gas through the couplings.

5. The detachable work extraction system of claim 3 further comprising an inlet valve assembly for controlling the flow of gas through the inlet.

6. The detachable work extraction system of claim 5 wherein the inlet valve assembly includes an electric actuated spring biased valve.

7. The detachable work extraction system of claim 3 further comprising an outlet valve assembly for controlling the flow of gas through the outlet.

8. The detachable work extraction system of claim 7 wherein the outlet valve assembly includes a pneumatic actuated spring biased valve.

9. The detachable work extraction system of claim 3 further comprising a return assembly for lowering the piston.

10. The detachable work extraction system of claim 9 wherein the return assembly is pneumatically controlled.

11. The detachable work extraction system of claim 1 wherein the expansion engine comprises a cylinder housing a piston, the work extraction system further comprising a displacement transducer for monitoring the position of the piston.

12. The detachable work extraction system of claim 1 wherein the hydraulic work extractor comprises a cylinder, piston, and oil loop.

13. The detachable work extraction system of claim 1 wherein the hydraulic work extractor includes a control valve for dissipating the work produced by the expansion of the gas.

14. The detachable work extraction system of claim 13 wherein the control valve includes a throttle valve.

15. The detachable work extraction system of claim 13 wherein the control valve includes a check valve.

16. A refrigeration system, comprising a cold box including a first self-sealing coupling for conveying cryogenic gas, and a detachable work extraction system, including an expansion engine having a second self-sealing coupling for conveying cryogenic gas, the second self-sealing coupling detachably connecting the expansion engine to the cold box self-sealing coupling.

17. The refrigeration system of claim 16 wherein the work extraction system further comprises a hydraulic work extractor operatively connected to the expansion engine, wherein a gas travels from the cold box to the expansion engine through the self-sealing coupling, the gas is cooled by expansion of the gas in the expansion engine and work produced by the expansion of the gas is dissipated by the hydraulic work extractor.

18. A method for connecting a cold box and a work extraction engine to convey cryogenic gas therebetween, comprising:

detachably connecting the work extraction engine to the cold box, and removably disconnecting the work extraction engine from the cold box without substantial loss of gas from the cold box.

19. The detachable work extraction system of claim 1 wherein the work extraction system is portable.

20. The detachable work extraction system of claim 19 wherein the work extraction system weighs about 40 pounds.

21. The detachable work extraction system of claim 19 wherein the work extraction system is about four feet long.

22. The detachable work extraction system of claim 19 wherein the work extraction system is about six inches in diameter.

23. The detachable work extraction system of claim 19 wherein the work extraction system is about four feet long and six inches in diameter.

24. The detachable work extraction system of claim 23 wherein the work extraction system weighs about 40 pounds.

25. A detachable work extraction system, comprising:

a single-phase gas expansion engine including a self-sealing coupling adapted to detachably connect the expansion engine to a cold box, and a hydraulic work extractor operatively connected to the expansion engine, wherein a gas can travel from the cold box to the expansion engine through the self-sealing coupling, the gas is cooled by expansion of the gas in the expansion engine and work produced by the expansion of the gas is dissipated by the hydraulic work extractor.

* * * * *

UNITED STATES PATENT AND TRADEMARK OFFICE

CERTIFICATE OF CORRECTION

PATENT NO. : 6,202,421 B1
DATED : March 20, 2001
INVENTOR(S) : Maguire et al.

It is certified that error appears in the above-identified patent and that said Letters Patent is hereby corrected as shown below:

Title page,
Under References Cited, insert:

| | | | |
|---|---|---|---|
| -- 5,345,769 | 9/1994 | Liepert et al. | ....62/6 -- |
| -- 5,317,874 | 6/1994 | Penswick et al. | ....60/577 -- |
| -- 5,099,650 | 3/1992 | Crunkleton | .... 62/6 -- |
| -- 4,862,694 | 9/1989 | Crunkleton et al. | ....62/6 -- |
| -- 4,956,974 | 9/1990 | Planchard et al. | ....62/6 -- |
| -- 3,438,220 | 4/1969 | Collins et al. | ....23/285 -- |
| -- 2,607,322 | 8/1952 | Collins et al. | ....121/117 -- |

-- Johnson et al., "Hydraulically Operated Two-Phase Helium Expansion Engine" pp. 1-4; (circa 1970) --

Signed and Sealed this

Eleventh Day of December, 2001

*Attest:*

Nicholas P. Godici

NICHOLAS P. GODICI
*Acting Director of the United States Patent and Trademark Office*

*Attesting Officer*